United States Patent [19]

Schmidt et al.

[11] 4,274,405

[45] Jun. 23, 1981

[54] METHOD FOR VARYING THE AMBIENT PRESSURE IN A VESSEL

[75] Inventors: Thomas C. Schmidt, Lake Park; Charles R. Yemington, Palm Beach Gardens, both of Fla.

[73] Assignee: Perry Oceanographics, Inc., Riviera Beach, Fla.

[21] Appl. No.: 50,487

[22] Filed: Jun. 20, 1979

[51] Int. Cl.[3] ..... A62B 11/36

[52] U.S. Cl. ..... 128/205.26; 405/192; 405/193; 137/207.5

[58] Field of Search ..... 128/205.26, 201.27, 128/201.28, 201.29, 202.14; 405/192, 193, 185; 114/314, 312, 333, 331, 322, 323, 324, 325; 137/207.5

[56] References Cited

U.S. PATENT DOCUMENTS

| | | | |
|---|---|---|---|
| 1,131,712 | 3/1915 | Klein | 114/312 |
| 1,772,459 | 8/1930 | Grieshaber | 114/336 |
| 2,113,779 | 4/1938 | Williamson | 128/201.27 |
| 2,784,559 | 3/1957 | Kajmo | 405/193 |
| 3,323,312 | 6/1967 | Banjavich | 405/193 |
| 3,408,822 | 11/1968 | Chate et al. | 114/314 X |
| 3,548,516 | 12/1970 | Lanphier et al. | 405/193 X |
| 3,851,487 | 12/1974 | Lambertsen | 114/312 X |
| 3,880,157 | 4/1975 | Elifritz | 128/201.27 |
| 3,968,656 | 7/1976 | Ball et al. | 405/193 |
| 4,011,867 | 3/1977 | Arntzen | 128/205.26 |
| 4,026,283 | 5/1977 | Banjavich et al. | 128/201.27 |
| 4,087,980 | 5/1978 | Kono | 114/314 X |

FOREIGN PATENT DOCUMENTS

| | | |
|---|---|---|
| 1531674 | 1/1970 | Fed. Rep. of Germany . |
| 1909823 | 9/1970 | Fed. Rep. of Germany . |

*Primary Examiner*—Henry J. Recla

*Attorney, Agent, or Firm*—Spencer & Kaye

[57] ABSTRACT

The ambient pressure of the environment of an individual within a vessel is varied between an upper and lower pressure value by providing the vessel with a mass of gas sufficient to fill at least a substantial part of the vessel, and varying the quantity of liquid, primarily water, in the vessel in order to cause the pressure therein to vary correspondingly between the upper and lower values.

21 Claims, 2 Drawing Figures

METHOD FOR VARYING THE AMBIENT PRESSURE IN A VESSEL

BACKGROUND OF THE INVENTION

The present invention relates to varying the ambient pressure to which individuals are exposed, and particularly to compression and decompression of divers for passage to and from undersea work locations.

Because of the reaction of the human body to substantial changes in ambient pressure and particularly its inability to tolerate rapid pressure reductions, it has always been necessary for divers to undergo carefully controlled decompression procedures following deep dives, and a wide variety of devices and systems has been employed for carrying out these procedures.

In recent years, various factors have created a need to perform undersea tasks at increasingly great depths, and submersible pressure vessels have been developed to transport divers between worksites at those depths and the surface.

Such pressure vessels may be arranged to be lowered to the worksite from a surface support vessel, the pressure vessel then functioning as a diving bell, or it may be part of an independently movable, i.e. untethered, submarine, the pressure vessel then constituting part of a diver lockout submersible, or the pressure vessel may form part of a quasi-permanent undersea structure, or habitat.

The interior of the pressure vessel can be brought to the worksite ambient pressure either before or after reaching the worksite.

In known arrangements, pressure within the vessel is increased by introducing gas from a high pressure supply. The containers constituting this supply are extremely bulky and heavy and in some cases may constitute a major portion of the system or vehicle.

In order to return the interior of the pressure vessel to a reduced, i.e. surface atmosphere, pressure, gas therein is simply vented to the outside either during or after return of the vessel to the surface. Depressurization is not performed while the pressure vessel is at the worksite depth because a compressor capable of expelling gas at an appropriate rate against the ambient pressure of the surrounding sea water would present unacceptably high weight, power and volume requirements.

According to another approach to permitting the performance of work by divers at the sea floor, which is applicable to a limited range of situations where the work is to be performed on equipment installed at the sea floor within a pressure-tight, water-filled chamber, it has been proposed to bring the pressure in that chamber to one atmosphere before diver entry. One system, which has been proposed by Vickers-Intertek, for this purpose is known as the neutrabaric system. In this system, which is particularly applicable to the servicing of wellheads, the wellhead components which are to be available for servicing are housed in a chamber which is connected to a second water-filled transfer chamber, the interior of the two chambers being in communication via a passage which is sufficiently large to accomodate a diver. Divers are brought to the worksite in a third chamber constituting a dry, one-atmosphere unit which is mated to a passage presented by the second chamber. The interior of the third chamber is then placed in communication with the interiors of the first and second chambers, so that the water in the latter chambers can be expanded into the bottom of the third chamber to bring the interiors of all three chambers to a pressure of one atmosphere. This result can easily be achieved because a very small change in the volume of a given mass of water corresponds to a substantial pressure change. For example, at a depth of 700 feet, where the ambient pressure is of the order of 20 atmospheres, the volume of a given mass of water must increase by only 0.1 percent in order to bring the pressure in that mass of water to a value of one-atmosphere.

Thus, the concept underlying this system is to always maintain divers in a one-atmosphere enviroment, thereby eliminating any need for decompression, which is possible only when work is to be performed on equipment already housed in a water-tight, pressure resistant chamber. This system is incapable of producing a meaningful or controlled variation in the ambient pressure to which the divers are exposed.

It is also known to effect escape from a submerged, disabled submarine via an excape trunk connected to the submarine, by a procedure in which a submarine enters the trunk from the submarine, the trunk is then sealed and its interior pressure is raised as rapidly as possible from the submarine interior pressure to the ambient pressure of the surrounding sea water, and the trunk is then opened to the sea and the submariner exits from the trunk and ascends to the surface. Sea water is introduced into the trunk either to raise the pressure therein to ambient or to displace the gases therein, and in the latter case subsequent rapid compression is effected by introduction of a high pressure gas. No control is exerted over the rate of pressurization—in fact pressurization proceeds as rapidly as possible for the purpose of eliminating the need to subsequently perform a controlled depressurization—and a submariner is never subjected to depressurization within the trunk.

SUMMARY OF THE INVENTION

It is an object of the invention to provide an improved procedure for adapting individuals to substantial pressure changes.

A more specific object of the invention is to effect diver compression and decompresssion in a simple and cost saving manner.

A further specific object of the invention is to substantially reduce, or eliminate the need for any compressed gas supplies to effect compression and decompression.

Another object of the invention is to provide the capability for performing decompression at any depth, including the working depth.

These and other objects are achieved, according to the invention, by a method for varying the ambient pressure of the environment of an individual within a vessel between an upper and lower pressure value, which is carried out by providing the vessel with a mass of gas, normally air or another breathable composition, sufficient to fill at least a substantial part of the vessel when the pressure is at the lower value; providing the vessel with a mass of liquid sufficient to fill at least a substantial part of the vessel when the pressure is at the upper value; and varying the quantity of water in the vessel in order to cause the pressure therein to vary correspondingly between the upper and lower values.

The invention is conceived primarily for subjecting divers to compression for performance of tasks at a selected depth and for subsequently decompressing divers to surface atmospheric pressure. For these purposes the liquid employed is preferably water taken from the body of water in which the vessel is immersed.

The present invention offers the advantages, inter alia, of significantly reducing, or eliminating, gas consumption to effect compression and decompression, and permitting decompression to surface pressure even while submerged without requiring large, heavy compressors which have high power requirements.

A significant advantage of the invention is that it permits the use of a side-mounted diver lockout hatch, since compression is intended to result in a water level inside the vessel which is above the uppermost point of the hatch. Such a side-mounted hatch facilitates diver egress and ingress and offers the particular benefit of facilitating recovery of an unconscious diver via a neutral buoyancy recovery. In addition, the side-mounted hatch eliminates bottom clearance problems, associated with the bottom hatch required in conventional gas pressurization methods.

Moreover, the method according to the invention permits of an improved decompression technique in that a major portion of decompression is effected in a "head out immersion" condition, which enhances inert gas elimination from the body. In addition, decompression according to the invention can readily be performed by withdrawing water at a constant rate, thereby easily permitting an exponential pressure reduction, which for some pressure/time exposures may be physiologically superior to the linear pressure reduction produced by removing gas at a constant mass rate.

DESCRIPTION OF THE PREFERRED EMBODIMENTS

Figure 1:
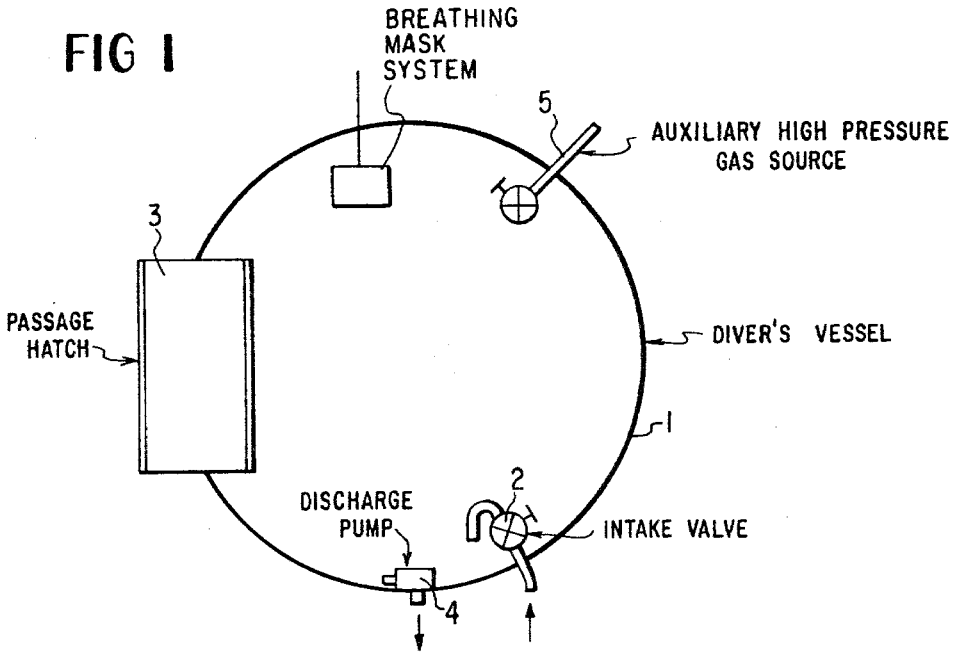
FIG. 1 is a schematic, elevational view of the interior of a vessel equipped to operate according to a first preferred embodiment of the invention.

FIG. 1 illustrates a basic preferred embodiment of the invention which offers the advantage that it requires no auxiliary vessel or container. According to this embodiment, the diver's vessel is initially filled with air at atmospheric pressure, for example at the surface. It can then be lowered to the diving depth, either with the divers on board or with the divers having descended in a different vehicle or in a free dive.

An intake valve 2 in vessel 1, is opened, either while the vessel is being lowered or after the vessel has reached the diving depth, to admit water to the vessel. If the vessel is to be used in such a manner that flow of water between the surrounding sea and the vessel interior is to be controlled from the outside, valve 2 can be mounted outside the vessel or can be equipped with a control extending outside the vessel. As water enters, the gas within the vessel becomes increasingly compressed in the upper part of the vessel interior until its pressure comes into equilibrium with the ambient pressure at the diving vessel depth. The vessel may also be equipped with an auxiliary source 5 of gas under high pressure from which gas can be supplied to the vessel interior if necessary, for example to maintain a minimum volume of trapped gas or to maintain physiologically acceptable partial pressures of the gaseous components.

If divers are present in the vessel during its descent, pressurization is controlled at a rate which assures safe and comfortable diver compression, and the divers can than leave the vessel via either a side-mounted exit hatch 3 or a bottom hatch to perform their tasks.

At the end of a dive, divers can swim easily through the side hatch 3 into the water-filled vessel and can then assume a standing or seated position with their heads extending into the gaseous region at the top of the vessel.

Then decompression proceeds by withdrawing water from the vessel at a rate determined by the decompression requirement of the divers. This can be effected by a discharge pump 4 at the bottom of the pressure vessel, it having been found that water can be discharged in this manner by a low capacity pump at a rate which can be accurately controlled to effect safe decompression.

The pump 4 can be operated to discharge the water while the vessel remains at the diving depth, or the water can be permitted to flow out of the vessel at a controlled rate while the vessel is being raised to the surface or after it reaches the surface. Any residual excess gas which may remain due to having been added as part of the compression sequence, may then be simply vented. If the entire decompression to 1 atm pressure is to occur in the submerged condition, this relatively small volume of gas may be removed using a relatively small compressor.

In accordance with a further embodiment of the invention, control of the pressure in the diver's vessel is effected by exchange of water between that vessel and an associated water tank. The combined weight of this system remains constant as the diver's vessel pressure is varied, so that the entire system can remain neutrally buoyant to facilitate, inter alia, midwater diver lockout.

Figure 2:
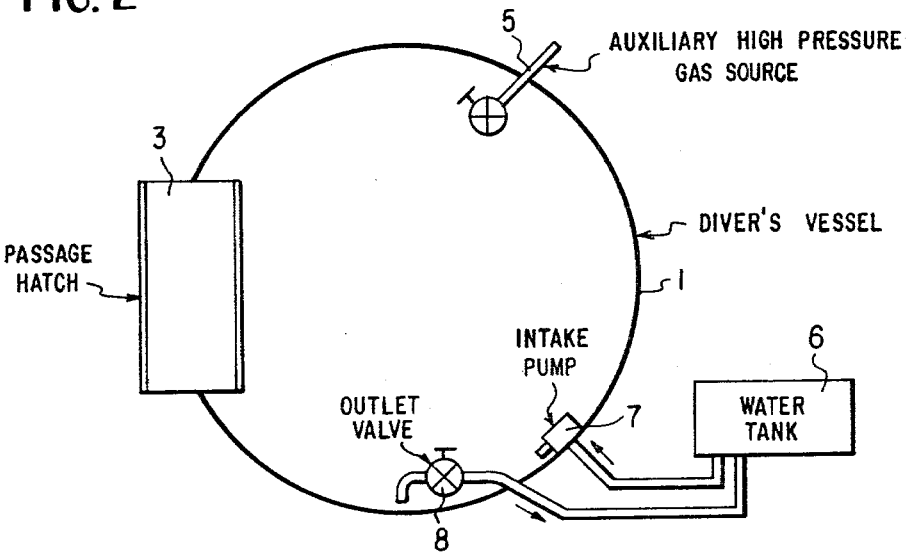
FIG. 2 is a view similar to that of FIG. 1 of a vessel equipped to operate according to a second preferred embodiment of the invention.

One embodiment of a system constructed to operate in this manner is shown in FIG. 2 and includes, in addition to the diver's vessel, a water tank 6 having a capacity at least equal to the quantity of water which must be removed from the diver's vessel during an operating cycle and dimensioned and possibly filled with a charge of gas to assure that the pressure in the water tank is always above the minimum inlet pressure of an intake pump 7 disposed in vessel 1, and is approximately equal to one atmosphere when all water in the system is in the water tank. To pressurize the diver's vessel, water is pumped thereinto by the pump 7 from the water tank 6 until the vessel interior is at the diving depth pressure. Decompression is attained by opening an outlet valve 8 disposed in the diver's vessel to permit water to flow through a conduit connected to the water tank at a controlled rate.

One advantage of this procedure is that decompression is an essentially passive operation which can proceed even if a power failure should occur.

Each of the above-described systems may also include an attached manned normo baric pressure vessel in which case the pump, and water and gas supply valves may be located in the manned normo baric pressure vessel and in the embodiment of FIG. 2. The water tank may have the capability of being brought into pressure equilibrium with the normo baric chamber.

Likewise, the method according to the invention could also advantageously be employed in conjunction with a submarine to permit passage out of and back into the submarine while it is submerged, thereby providing a convenient and efficient means for making underwater exterior repairs, conducting sea floor exploration and effecting escapes from crippled vessels.

For such purposes, the diver's vessel would be provided with a bottom hatch for mating with a hatch on the deck of the submarine as well as with a side hatch. The vessel would further be provided with a coupling arranged for connection to a tank analogous to tank 6, disposed in the submarine, for holding a mass of water at the ambient pressure within the submarine, and possibly with a valve via which the interior of the vessel can be placed in communication with the surrounding sea. In addition, a pump could be provided in the pressure vessel, either for pumping water from the vessel back into the sea, or for pumping water from the submarine tank into the vessel.

To use the vessel for passage out of and into a submerged submarine, the bottom hatch of the vessel is mated to the submarine deck hatch and both hatches are opened, placing the vessel and submarine interiors in communication. The interior of the vessel is then dry and at the submarine interior pressure, and can be entered from the submarine.

The vessel hatch is then closed and the vessel is filled with water to bring its interior to the ambient sea pressure. This can be achieved either by opening the valve which communicates between the vessel interior and the sea or by pumping water into the vessel from the tank disposed in the submarine.

The side hatch is then opened for passage of the diver into the sea to perform any necessary inspection and repairs.

To return to the submarine, the diver reenters the vessel via the side hatch, which is then closed, and the water is removed from the vessel, either by pumping it into the sea or venting it to the tank disposed in the submarine, at the rate dictated by diver decompression requirement, until the pressure within the vessel returns to the submarine interior pressure. The communicating hatches are then opened and the diver reenters the submarine.

The provision of the above-described water holding tank in the submarine offers the advantage of permitting completely passive cycling of vessel interior pressure, at least for one or a small number of uses. Thus, the vessel interior pressure can be varied from the submarine interior pressure to the ambient sea pressure by opening the valve connected in a line extending therebetween, the extent to which the valve is opened determining the rate of pressure rise. Return to the submarine interior pressure can then be effected by opening the valve connected in a line between the vessel interior and the tank in the submarine, again the rate of pressure drop being controlled by adjusting the valve opening.

The invention is preferably practiced using vessels having a size and shape sufficient to assure that at the highest pressure to be encountered the portion of the top of the vessel which is filled with gas will be of sufficient size to enable the divers to comfortably maintain their heads out of water, taking into account that the proportion of the vessel volume occupied by a given mass of gas will be substantially linearly inversely proportional to the absolute pressure in the vessel, assuming no change in temperature.

Of course, the pressure vessel must be connected to a source of a breathable atmosphere which can be pumped in according to known techniques during decompression or compression, without substantially influencing pressure conditions in the vessel.

Pressure vessels for carrying out the invention will normally be provided with a source of a breathable gas supply, an atmosphere conditioning unit, and use of a separate mask breathing supply system of an open, closed, or semi-closed nature, are all expected features of any embodiments, that are incidental to the ambient pressure variation methods described herein. The pressure vessel of the invention may be part of a larger underwater system, such as a diver lockout system or an underwater habitat, or can be used in conjunction with a separate underwater system, such as a submarine, as described above, or an underwater habitat.

It will be understood that the above description of the present invention is susceptible to various modifications, changes and adaptations, and the same are intended to be comprehended within the meaning and range of equivalents of the appended claims.

What is claimed is:

1. A method for varying the ambient pressure of the environment of an individual totally enclosed within a vessel between an upper and lower pressure value, comprising: providing the vessel with a mass of gas and with a mass of liquid, the mass of liquid being sufficient to fill at least a substantial part of the vessel when the pressure is at the upper value; and varying the quantity of liquid in the vessel in order to cause the pressure therein to vary correspondingly between the upper and lower values.

2. A method for varying the ambient pressure of the environment of an individual totally enclosed within a vessel between an upper and lower pressure value, comprising: providing the vessel with a mass of gas sufficient to fill at least a substantial part of the vessel when the pressure is at the lower value; providing the vessel with a quantity of liquid; varying the quantity of liquid in the vessel in order to cause the pressure therein to vary correspondingly between the upper and lower values; and maintaining the quantity of gas present in the vessel constant during at least part of said step of varying.

3. A method for varying the ambient pressure of the environment of an individual totally enclosed within a vessel between an upper and lower pressure value, comprising: providing the vessel with a mass of gas sufficient to fill at least a substantial part of the vessel when the pressure is at the lower value; providing the vessel with a quantity of liquid; and varying the pressure in the vessel between the upper and lower values by correspondingly varying substantially only the quantity of liquid therein.

4. A method as defined in claim 1, 2 or 3 wherein said step of varying the quantity of liquid comprises pumping the liquid in at least one direction between the interior and exterior of the vessel.

5. A method as defined in claim 1, 2 or 3 wherein said step of varying comprises reducing the pressure in the vessel from the upper value to the lower value at a rate dictated by human physiological requirements.

6. A method as defined in claim 5 wherein the liquid is water and the vessel is submerged in a body of water during at least a portion of said step of varying.

7. A method as defined in claim 6 wherein said step of varying comprises: conducting water into the lower portion of the vessel to increase the pressure therein; and removing water from the vessel to reduce the pressure therein.

8. A method as defined in claim 7 wherein said step of conducting comprises opening a passage between the body of water and the lower portion of the vessel to permit water to enter the vessel to establish pressure equilibrium between the interior and exterior of the vessel.

9. A method as defined in claim 8 wherein said step of removing comprises pumping water out of the vessel.

10. A method as defined in claim 8 wherein said step of removing comprises raising the vessel and opening a passage between the body of water and the lower portion of the vessel to permit water to leave the vessel.

11. A method as defined in claim 7 wherein the vessel is connected to a tank containing a supply of water, said step of conducting is carried out by causing water to flow from the tank into the vessel.

12. A method as defined in claim 11 wherein said step of conducting comprises pumping water from the tank into the vessel and said step of removing comprises venting water from the vessel to the tank.

13. A method as defined in claim 1, 2 or 3 further comprising permitting individuals to pass in and out of the vessel via an opening in the side, or bottom, thereof.

14. A method as defined in claim 1, 2 or 3 further comprising introducing additional gas from a high pressure source into the vessel for maintaining a desired minimum volume of gas and/or physiologically acceptable partial pressures of the components of the mass of gas.

15. A method as defined in claim 1, 2 or 3 further comprising supplying a breathable gas to the interior of the vessel.

16. A method as defined in claim 1, 2 or 3 further comprising providing a separate mask breathing system for divers in the vessel.

17. A method as defined in claim 1, 2 or 3 wherein the vessel is part of a larger underwater system.

18. A method as defined in claim 17 wherein the underwater system is a diver lockout submersible or an underwater habitat.

19. A method as defined in claim 1, 2 or 3 wherein the vessel is used in conjunction with a separate underwater system.

20. A method as defined in claim 19 wherein the underwater system is a submarine or an underwater habitat.

21. A method as defined in claim 1 wherein the mass of gas is sufficient to fill at least a substantial part of the vessel when the pressure is at the lower value.

* * * * *